US008299723B2

(12) United States Patent
Nagata et al.

(10) Patent No.: US 8,299,723 B2
(45) Date of Patent: Oct. 30, 2012

(54) ELECTRONIC BALLAST WITH LAMP FLICKER SUPPRESSION DURING START-TO-STEADY STATE TRANSITION

(75) Inventors: Satoru Nagata, Kobe (JP); Jun Kumagai, Suita (JP); Nobutoshi Matsuzaki, Neyagawa (JP)

(73) Assignee: Panasonic Corporation, Osaka (JP)

( * ) Notice: Subject to any disclaimer, the term of this patent is extended or adjusted under 35 U.S.C. 154(b) by 283 days.

(21) Appl. No.: 12/606,247

(22) Filed: Oct. 27, 2009

(65) Prior Publication Data

US 2010/0109546 A1 May 6, 2010

(30) Foreign Application Priority Data

Oct. 28, 2008 (JP) ..... 2008-277400

(51) Int. Cl.
*H05B 37/00* (2006.01)

(52) U.S. Cl. ..... 315/291; 315/244; 315/209 R; 315/307; 315/224

(58) Field of Classification Search ..... 315/224, 315/225, 307–311, 247, 209 R, 291, 244
See application file for complete search history.

(56) References Cited

U.S. PATENT DOCUMENTS 5,677,602 A * 10/1997 Paul et al. ..... 315/224
5,914,571 A * 6/1999 Beasley ..... 315/244
5,932,976 A * 8/1999 Maheshwari et al. ..... 315/291
2004/0257000 A1* 12/2004 Langeslag ..... 315/209 R
2006/0017405 A1* 1/2006 Breuer et al. ..... 315/307
2010/0134030 A1* 6/2010 Huijbrechts et al. ..... 315/224

FOREIGN PATENT DOCUMENTS

WO WO03039206 5/2003

* cited by examiner

*Primary Examiner* — Douglas W Owens
*Assistant Examiner* — Amy Yang
(74) *Attorney, Agent, or Firm* — Waddey & Patterson, P.C.; Mark J. Patterson; Gary L. Montle

(57) ABSTRACT

An electronic ballast is provided for powering a discharge lamp and suppressing lamp flicker during startup transition. A power converter receives DC input power and converts it into an AC power output. A resonant circuit is coupled with the lamp and also between output terminals of the power converter. A controller controls the power converter with respect to particular modes of operation. The controller in a starting operation sets the output frequency of the power converter to a predetermined start frequency upon lamp startup to make the lamp begin discharging. The controller shifts from the starting operation to steady-state operation by setting the output frequency of the power converter at a predetermined steady-state frequency lower than the start frequency. The predetermined start frequency is set to a frequency identical or close to 1/(an odd whole number) of the resonant frequency of the resonant circuit with the lamp unlit, and also to a frequency identical or close to the resonant frequency of the resonant circuit with the discharge lamp lit. The start frequency is sufficient to make the discharge lamp start discharging, and to raise a temperature of each electrode of the discharge lamp after lamp startup and by an end of the starting operation.

22 Claims, 6 Drawing Sheets

ELECTRONIC BALLAST WITH LAMP FLICKER SUPPRESSION DURING START-TO-STEADY STATE TRANSITION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japan Patent Application No. JP2008-277400, filed Oct. 28, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic ballasts for powering a discharge lamp. More particularly, the present invention relates to an electronic ballast for suppressing discharge lamp flicker during a transition from lamp startup to steady-state operation.

Conventionally, an electronic ballast for lighting a hot-cathode discharge lamp such as a high pressure discharge lamp (also called HID (high-intensity discharge lamp) is provided with a power converter for converting input DC power to output AC power, a resonant circuit connected between output terminals of the power converter, along with the discharge lamp, and a controller for controlling the power converter.

In an example of such an electronic ballast as known in the art, the controller executes a starting operation for raising an output voltage of the power converter relatively higher to start the discharge lamp, and then begins a steady-state operation in which the power converter is controlled to output to the lamp the AC power for maintaining the lighting of the discharge lamp.

More specifically, the starting operation makes the discharge lamp output a high starting voltage by setting an output frequency of the power converter (hereinafter referred to as an "operating frequency") to a resonant frequency of the resonant circuit and the discharge lamp (hereinafter referred to as a "load circuit") with the discharge lamp unlit, or to approximately 1/(n) of the resonant frequency over a predetermined starting time, where "n" is an odd number greater than 3.

Here, the resonant frequency of the load circuit changes in accordance with the beginning of the discharge of the discharge lamp, i.e., the starting thereof. Then, when an operation frequency during the starting operation is far from the resonant frequency of the load circuit after the starting of the discharge lamp, the electric power supplied to the discharge lamp by the end of the starting operation relatively decreases, thereby relatively lowering the temperature of each electrode of the discharge lamp. Therefore, the discharge becomes unstable at the time of beginning the steady-state operation, which may generate lamp flicker and an imperfect lighting.

BRIEF SUMMARY OF THE INVENTION

In view of foregoing, an object of the present invention is to provide an electronic ballast capable of suppressing a flicker and an imperfect lighting at the time of shifting from lamp startup to steady-state operation.

An aspect of the present invention is characterized by including a power converter receiving DC power input thereto and outputting AC power, a resonant circuit coupled to the discharge lamp, the resonant circuit being further connected between output terminals of the power converter, and a controller controlling the power converter. The controller executes a starting operation to make the discharge lamp start discharging by setting an output frequency of the power converter to a predetermined start frequency when starting the discharge lamp, followed by shifting to a steady-state operation by setting the output frequency of the power converter to a predetermined steady-state frequency lower than the start frequency. The steady-state operation makes the discharge lamp output the alternating current power for maintaining lighting of the discharge lamp.

The start frequency is set to a frequency identical or close to 1/(n) of the resonant frequency of the resonant circuit with the discharge lamp unlit, to an extent capable of causing the lamp to light. The start frequency is also identical or close to the resonant frequency of the resonant circuit with the discharge lamp lit, to an extent capable of sufficiently raising the temperature of each electrode of the discharge lamp after the starting of the discharge lamp and by the end of the starting operation.

The temperature of each electrode of the discharge lamp is preserved more effectively by the end of the starting operation, as compared to the case where the start frequency is far from the resonant frequency of the resonant circuit and the discharge lamp is lit, so that it is possible to suppress lamp flicker at the time of shifting to the steady-state operation.

Another aspect of the present invention is characterized wherein the controller executes a starting operation to by periodically changing an output frequency of the power converter within a predetermined start frequency range when starting the discharge lamp, followed by shifting to a steady-state operation by setting the output frequency of the power converter as a predetermined steady-state frequency lower than a lower limit of the start frequency range, the steady-state operation making the discharge lamp output the alternating current power for maintaining lighting of the discharge lamp. The start frequency range includes 1/(n) of the resonant frequency of the resonant circuit with the discharge lamp unlit, the "n" being any odd number, and the start frequency range further includes the resonant frequency of the resonant circuit with the discharge lamp lit.

The temperature of each electrode of the discharge lamp is thereby preserved more effectively by the end of the starting operation, as compared to the case where the start frequency range is far from the resonant frequency of the resonant circuit with the discharge lamp lit, so that it is possible to suppress flicker at the time of shifting to the steady-state operation.

Another aspect of the present invention is characterized wherein the start frequency range includes 1/(an odd number) of the resonant frequency of the resonant circuit with the discharge lamp unlit, does not include the resonant frequency of the resonant circuit with the discharge lamp lit, and is also set to a frequency close to the resonant frequency of the resonant circuit with the discharge lamp lit, to an extent capable of sufficiently raising temperature of each electrode of the discharge lamp after the starting of the discharge lamp by end of the starting operation.

Accordingly, the temperature of each electrode of the discharge lamp is preserved more effectively by the end of the starting operation as compared to the case where the start frequency range is far from the resonant frequency of the resonant circuit and the discharge lamp lit, so that it is possible to suppress flicker at the time of shifting to the steady-state operation.

Another aspect of the present invention is characterized in that the start frequency range is phase-shifted in relation to the resonant frequency of the resonant circuit with the discharge lamp lit.

Another aspect of the present invention is characterized in that the resonant circuit includes an inductor connected in series to the discharge lamp.

Another aspect of the present invention is characterized in that the resonant frequency of the resonant circuit with the discharge lamp unlit is greater than or equal to five times the resonant frequency of the resonant circuit with the discharge lamp lit.

Another aspect of the present invention is characterized in that the duration of the starting time is greater than or equal to a sum of a minimum time required for making the discharge lamp start discharging and a minimum time required for heating each electrode after the discharge lamp starts discharging.

Another aspect of the present invention is characterized in that the controller detects the starting of the lamp during the starting operation, and the operation shifts to the steady-state operation after a lapse of a certain period of electrode heating time subsequent to the detection of the starting of the lamp. The duration of the starting operation is thereby reduced to relieve the electrical stress applied on the discharge lamp, so that the life of the discharge lamp can be extended compared to the invention according to the previous aspects of the present invention.

Another aspect of the present invention is characterized in that the controller determines whether a half-wave discharge (rectification) is generated at the discharge lamp during the starting operation, and the operation shifts to the steady-state operation when it is determined that the half-wave discharge is not generated at the discharge lamp.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Various embodiments for carrying out the present invention will be described below with reference to the drawings.

Figure 1:
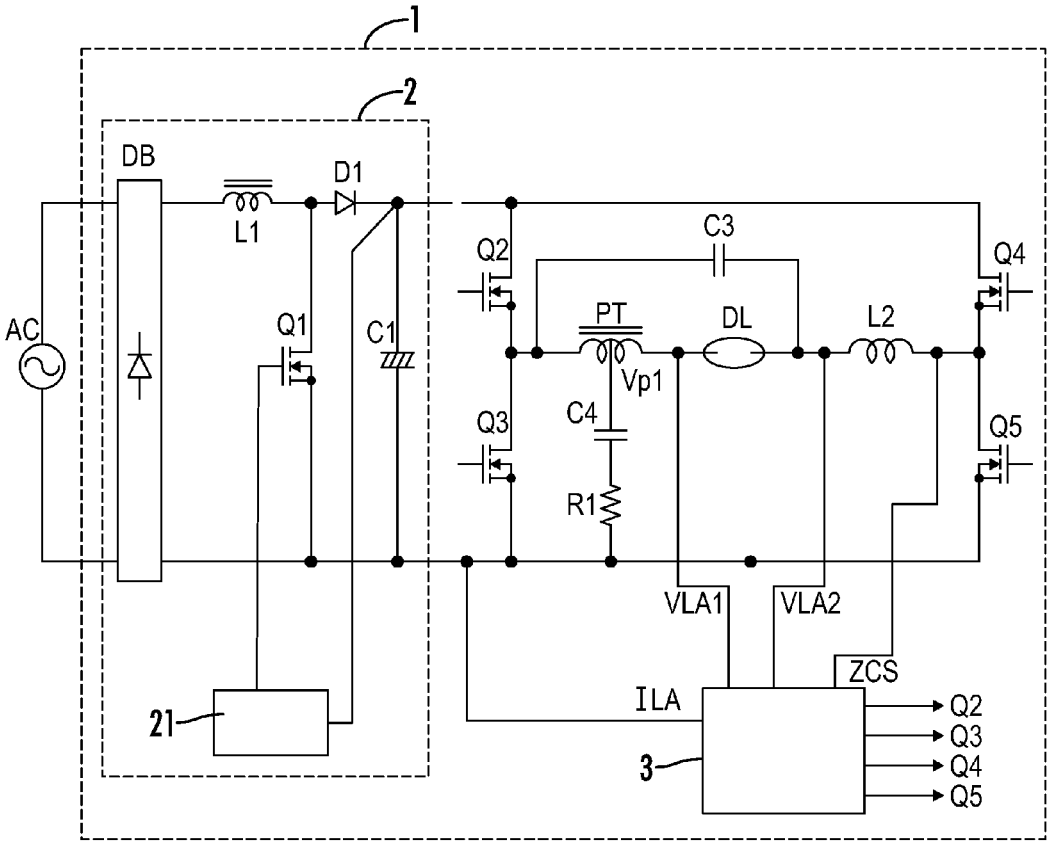
FIG. 1 is a circuit block diagram showing an embodiment of an electronic ballast of the present invention.

Referring now to FIG. 1, an electronic ballast 1 of the present invention is provided for lighting a hot cathode type discharge lamp DL, such as a high pressure discharge lamp which is also called HID (high-intensity discharge lamp). The ballast 1 as shown is provided with a full-bridge circuit including four switching elements Q2-Q5 as a power converter for converting DC power input from a DC power source 2 into AC power.

One of the output terminals of the full bridge circuit, i.e., the connection point of the switching elements Q2 and Q3 forming one of two series circuits which include two of the switching elements Q2-Q5 and are connected between the output terminals of the DC power source 2 in parallel with each other, is connected to one of the terminals of the discharge lamp DL (i.e., one of the electrodes) via a first inductor PT. The other output terminal of the full bridge circuit, i.e., the connection point of the switching elements Q4 and Q5 constituting the other series circuit, is connected to the other terminal of the discharge lamp DL (i.e., the other electrode) via a second inductor L2. The first inductor PT is an autotransformer having a tap that is connected to the ground via a series circuit of the first capacitor C4 and a resistance R1. Moreover, a second capacitor C3 is connected in parallel with the series circuit of the first inductor PT and the discharge lamp DL. The inductors PT and L2 and the capacitors C3 and C4 constitute a resonant circuit (hereinafter referred to as a "load circuit") together with the discharge lamp DL.

The DC power source 2, in which a well-known step-up chopper circuit (a boost converter) is connected to an output terminal of a diode bridge DB for full-wave rectifying of the AC power input from the AC power source AC, is provided with a series circuit of an inductor L1 connected between the output terminals of the diode bridge DB, a diode D1, and a capacitor C1, a switching element Q1 connected in parallel with the series circuit of the diode D1 and the capacitor C1, and a driving circuit 21 for controlling the switching element Q1 to turn on and off, which uses both ends of the capacitor C1 as the output terminal thereof.

The driving circuit 21 controls a duty ratio for turning on/off the switching element Q1 so that the output voltage, i.e., the voltage between both the ends of the capacitor C1, is set to be constant. The driving circuit 21 having features as described above can be realized by various well-known techniques, and any detailed illustrations and descriptions will be therefore omitted.

The ballast 1 of the present embodiment is provided with a controller 3 which drives the switching elements Q2 to Q5 respectively forming the full bridge circuit to turn on/off. The controller 3 drives the switching elements Q2 to Q5 to turn on/off so that the switching elements out of Q2 to Q5 located diagonally to each other are simultaneously turned on, and the switching elements out of Q2 to Q5 connected in series with each other are alternately turned on/off. This converts the DC power provided from the DC power source 2 into AC power, and the frequency of this AC power is the polarity inversion frequency due to the on/off driving (hereinafter referred to as an "operating frequency"). In the controller 3 as described above, a microprocessor such as for example ST72215 available from ST can be used, but the controller 3 is of course not limited to this specific example.

When power is turned on and the electronic ballast 1 begins starting, the controller 3 executes the starting operation for a certain period of starting time to set the operating frequency to a predetermined start frequency for starting the discharge lamp DL. In the present embodiment, the start frequency is set to the frequency nearly 1/11 of the resonant frequency of the load circuit with the discharge lamp DL unlit (hereinafter referred to as a "resonant frequency in the extinguished condition"), and to a frequency slightly higher than the resonant frequency in the lighting condition.

In the present embodiment, the resonant frequency in the extinguished condition is the resonant frequency of an LCR series resonant circuit of a primary winding portion of the first inductor PT as the autotransformer (i.e., the portion between the connection point of the switching elements Q2 and Q3 and the tap), the first capacitor C4, and the resistance R1, which is 440 kHz in the present embodiment. Therefore, the resonance voltage generated at the primary winding portion of the first inductor PT is increased by the first inductor PT to be applied to the discharge lamp DL. This voltage makes the discharge lamp DL start discharging at a starting time point t1 shown in FIG. 2. The discharge lamp DL is started (lit) and the output current (hereinafter referred to as a "lamp current") starts flowing to the discharge lamp DL, thereby decreasing the output voltage (hereinafter referred to as a "lamp voltage") Vla to the discharge lamp DL. In addition, as the impedance of the discharge lamp DL changes due to the starting (lighting) of the discharge lamp DL, the resonant frequency of the load circuit also changes to a resonant frequency under the lighting condition that is lower than the resonant frequency in the extinguished condition (about 20 kHz in the present embodiment).

Figure 2:
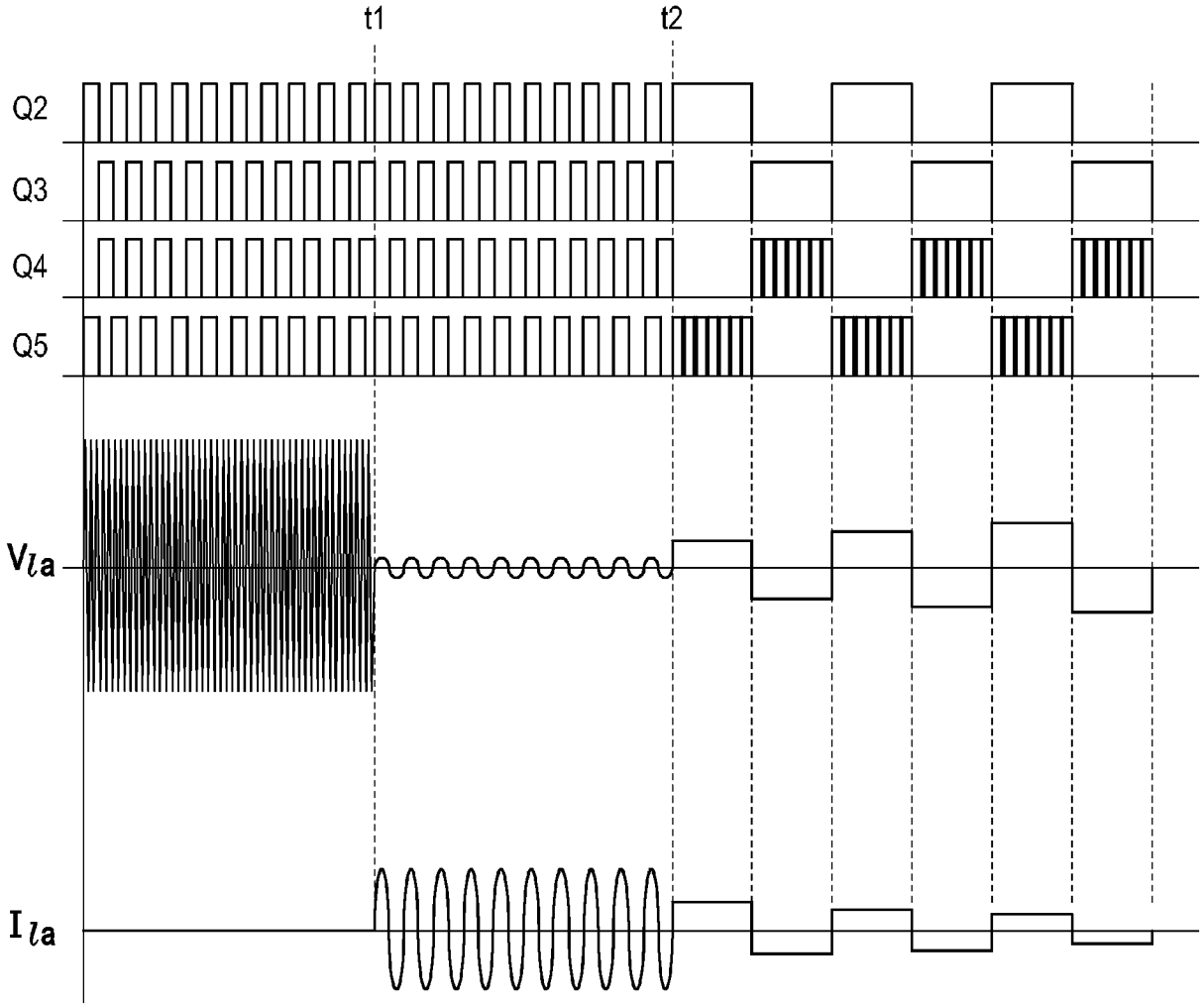
FIG. 2 is a graphical view showing operation of the ballast of FIG. 1.

After completing the starting operation at an operation switching time point t2 shown in FIG. 2, the controller 3 sets the operating frequency lower than the start frequency that is the operating frequency during the starting operation (for example, several tens of Hz to several hundreds of Hz) to start the steady-state operation for supplying a rectangular wave AC power to the discharge lamp to keep the discharge lamp DL lit. During the steady-state operation, the controller 3 executes a PWM control for adjusting the power supplied to the discharge lamp DL in which the switching elements Q4 and Q5 of one of the series circuits are not always turned on all the time when the switching elements Q2 and Q3 located diagonally thereto, but turned on/off with a predetermined duty ratio.

Figure 3:
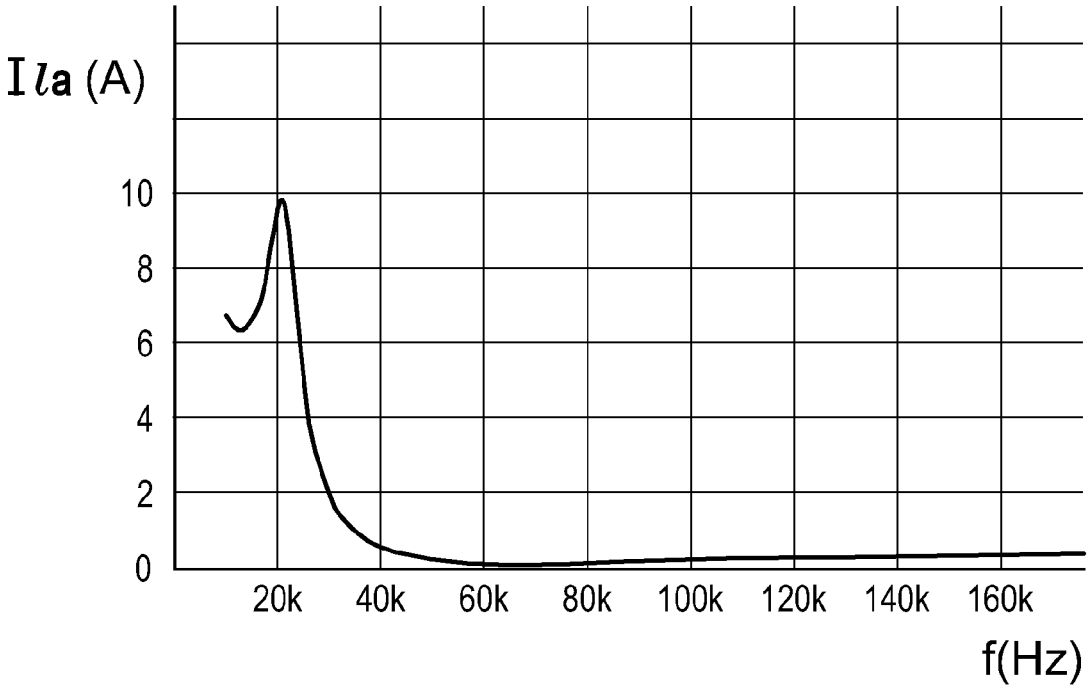
FIG. 3 is a graphical view showing a relationship between an operating frequency and a lamp current amplitude with the discharge lamp lit.

The relationship between the amplitude of the lamp current Ila and the operating frequency f in the present embodiment is shown in FIG. 3. In the present embodiment, the start frequency is set to approximately 40 kHz which is the frequency close to the resonant frequency under the lighting condition (about 20 kHz). In this manner the lamp current Ila having an amplitude of about 0.5 A can be secured that is necessary for each electrode of the discharge lamp DL to be sufficiently heated before the operation shifts to the steady-state operation after the starting of the discharge lamp DL. Therefore, each electrode of the discharge lamp DL can be sufficiently heated before the operation shifts to the steady-state operation to stabilize the lighting after shifting to the steady-state operation. Further, the frequency of 40 kHz is 1/11 (e.g., odd-number) of 440 kHz that is the resonant frequency in the extinguished condition, which is then suitable for the starting of the discharge lamp DL. Furthermore, the starting time is greater than or equal to the sum of the minimum time required for the starting of the discharge lamp DL (the starting of the discharge) and the minimum time required for heating each electrode after the starting of the discharge lamp DL (for example, 800 ms).

According to the structure described above, lamp flicker and an imperfect lighting at the time of shifting to the steady-state operation are suppressed compared to the case where the start frequency is far from the resonant frequency under the lighting condition (for example, the case where the start frequency is set to 100 kHz).

Figure 4:
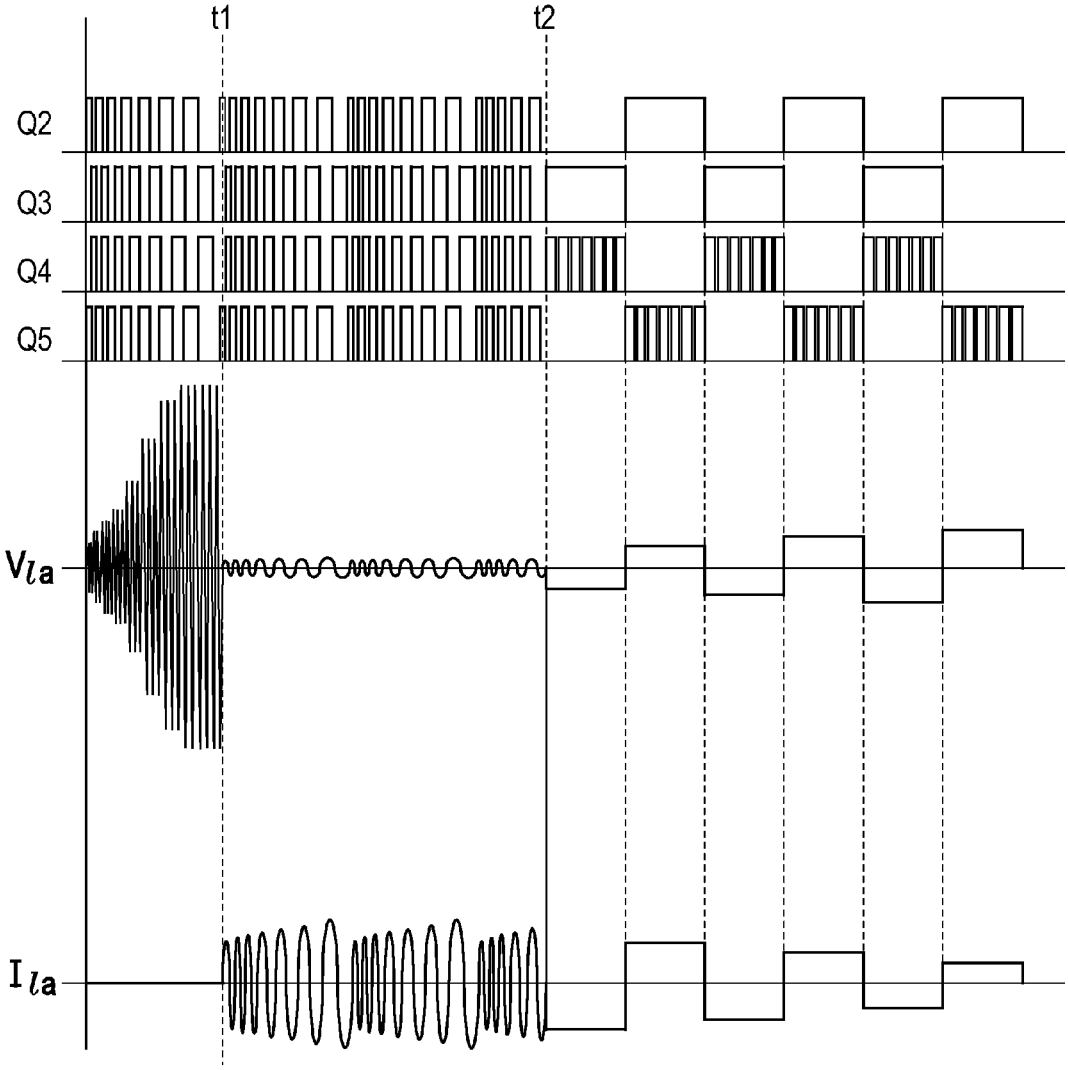
FIG. 4 is a graphical view showing an alternative operation of the ballast of FIG. 1.

Instead of setting the operating frequency f during the starting operation to be constant as described above, the operating frequency f may be changed periodically within a certain start frequency range during the starting operation, as shown in FIG. 4. In the example of FIG. 4, an operation is repeated in which the operating frequency f gradually decreases from a predetermined maximum frequency higher than 1/(an odd number) of the resonant frequency in the extinguished condition to a predetermined minimum frequency lower than 1/(the odd number) of the resonant frequency in the extinguished condition. That is, the start frequency range includes 1/(the odd number) of the resonant frequency in the extinguished condition. In such a case, the start frequency range may include the resonant frequency under the lighting condition, or the start frequency range may not include the resonant frequency under the lighting condition. If the start frequency range includes the resonant frequency under the lighting condition, the odd number is set to, for example, 25. If the start frequency range does not include the resonant frequency under the lighting condition, the odd number is set to, for example, 13 so that the start frequency range is set to a frequency greater than and close to the resonant frequency under the lighting condition, to the extent capable of sufficiently raising the temperature of each electrode of the discharge lamp DL after the starting of the discharge lamp DL by the end of the starting operation.

Further, instead of setting the duration of the starting operation to be the constant starting time as described above, a process may be implemented in which the controller 3 always or regularly determines whether the discharge lamp DL is started during the starting operation, and the operation shifts from the starting operation to the steady-state operation after a certain period of electrode heating time (for example, 500 ms) subsequent to the determination (detection) of the starting operation of the discharge lamp DL.

For example, a method for determining the starting of the discharge lamp DL includes detecting the amplitude of the voltage (refer to FIG. 5; hereinafter referred to as a "resonance voltage") Vp1 at a connection point between the first inductor PT and the first capacitor C4 to compare it to a predetermined starting threshold. The discharge lamp DL is determined to have not been started if the amplitude of the resonant voltage Vp1 is higher than or equal to the starting threshold, while the discharge lamp DL is determined to have been started if the amplitude of the resonant voltage Vp1 is lower than the starting threshold.

Figure 5:
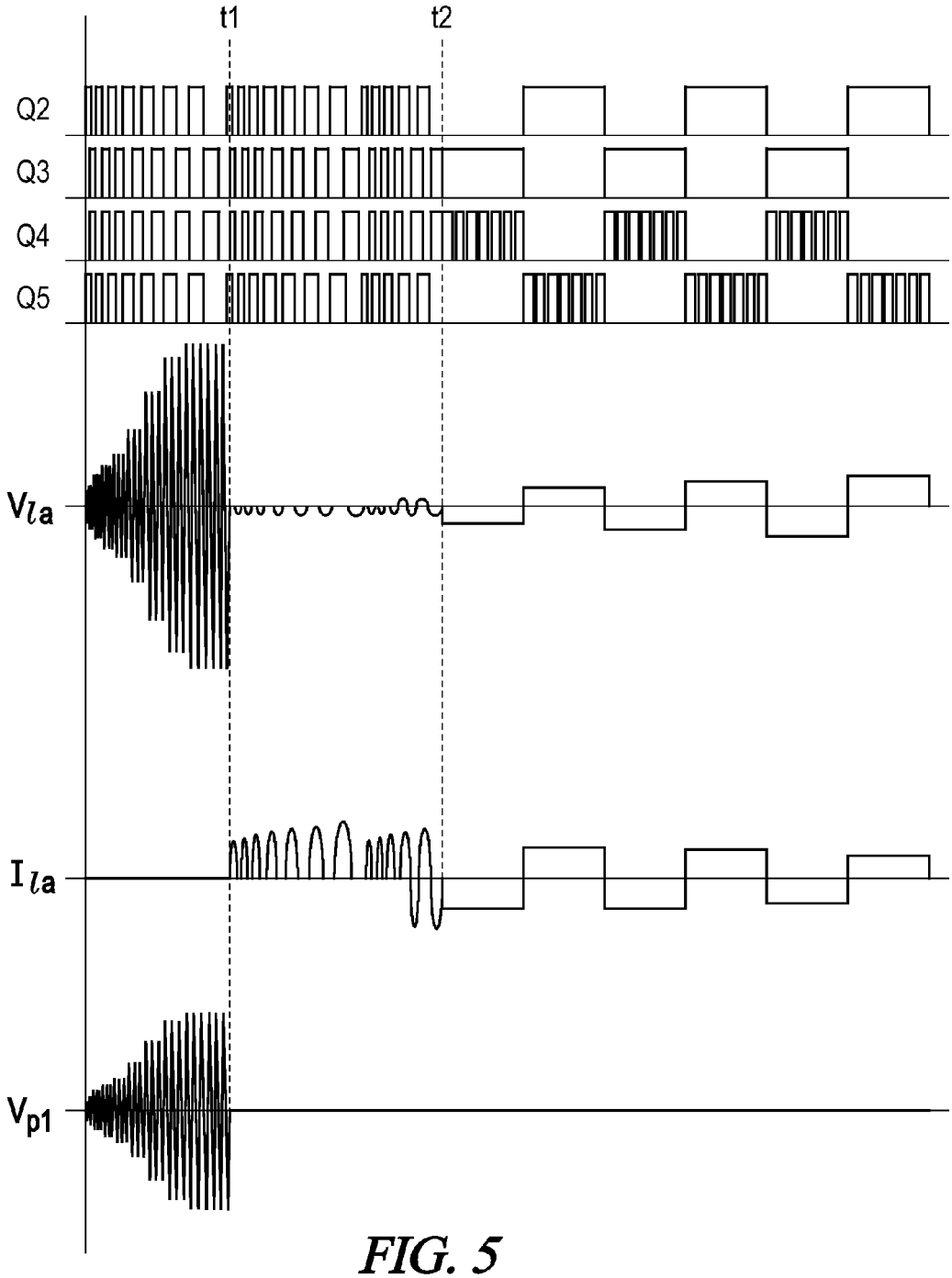
FIG. 5 is a graphical view showing another alternative operation of the ballast of FIG. 1.

As shown in FIG. 5, the amplitude of the resonance voltage Vp1 sharply decreases at time t1 when the discharge lamp DL is started to reach approximately 0, so that the starting of the discharge lamp DL can be determined based on the resonant voltage Vp1. Employing this structure can reduce the duration of the starting operation to relieve the electrical stress applied on the discharge lamp DL, so that the life of the discharge lamp DL can be extended compared to the case where the duration of the starting operation is set to be constant.

In addition, as depicted in FIG. 5, insufficient heating of each electrode of the discharge lamp DL generates half-wave discharge at the discharge lamp DL, and thus the lamp current Ila is more likely to become asymmetric with respect to positive and negative polarities thereof. In contrast, when the lamp current Ila is symmetric with respect to positive and negative polarities thereof, it can be regarded that each electrode of the discharge lamp DL is sufficiently heated. Then, the structure may be implemented in which the controller 3 always or regularly determines whether the half-wave discharge is generated at the discharge lamp DL during the starting operation, and the starting operation is terminated when it is determined that the half-wave discharge is not generated to shift to the steady-state operation.

More specifically, a method for determining whether the half-wave discharge is generated, for example, detects peak values (absolute values) of both positive and negative polarities of the lamp current Ila, compares the difference between the detected peak values for each polarity (hereinafter referred to as an "asymmetric current value") to a predetermined symmetric threshold, and determines that the lamp current Ila is symmetric with respect to positive and negative polarities thereof. Thus half-wave discharge is not generated if the asymmetric current value is lower than the symmetric threshold, while determining that the lamp current Ila is asymmetric with respect to positive and negative polarities thereof and thus the half-wave discharge is generated if the asymmetric current value is higher than or equal to the symmetric threshold. Employing this structure can reduce the duration of the starting operation to relieve the electrical stress applied on the discharge lamp DL, so that the life of the discharge lamp DL can be extended compared to the case where the duration of the starting operation is set to be constant, or the case where the operation shifts to the steady-state operation after the elapse of a certain period of time subsequent to the detection of the starting of the discharge lamp DL.

Further, as a method for determining the time to terminate the starting operation to shift to the steady-state operation, the starting time, the detection of lighting of the lamp, and the detection of the half-wave discharge may be used in combination. For example, the operation will shift to the steady-state operation at the latest among the elapsing of a predetermined starting time, the elapsing of a predetermined electrode heating time after detection of discharge lamp DL startup, and a time in which it is determined that the lamp current Ila is symmetric with respect to positive and negative polarities thereof and the half-wave discharge is not generated. The structure controller 3 which performs each operation as described above may be realized by various techniques as well known to one of skill in the art, and detailed illustrations and descriptions will be omitted as unnecessary.

In addition, any other well-known DC power source, such as a battery, may be used as the DC power source 2.

Figure 6:
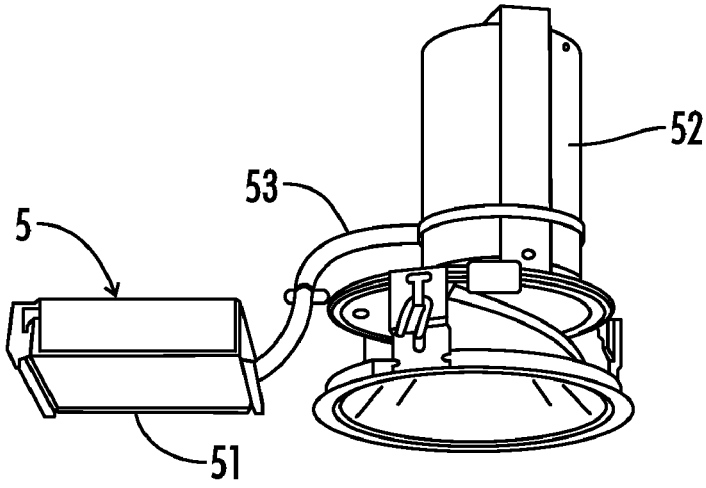
FIG. 6 is a perspective view showing an example of a lighting fixture using the ballast of the present invention.
Figure 7:
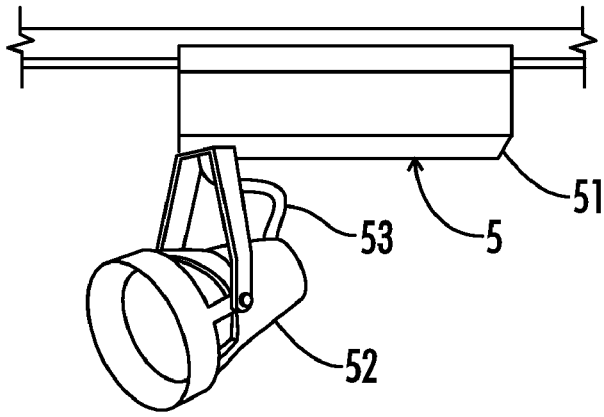
FIG. 7 is a perspective view showing another example of a lighting fixture using the ballast of the present invention.
Figure 8:
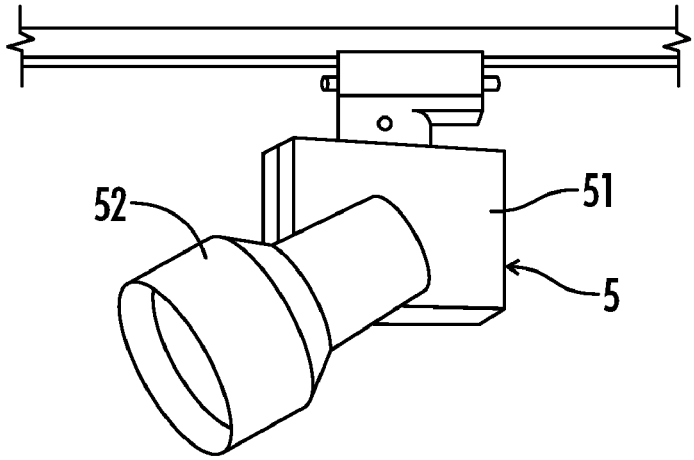
FIG. 8 is a perspective view showing still another example of the lighting fixture of the ballast of the present invention.

The various embodiments of electronic ballasts as described above can be used in, for example, lighting fixtures 5 shown in FIGS. 6 to 8. Each lighting fixture 5 shown in FIGS. 6 to 8 is provided with a fixture main body 51 accommodating the electronic ballast 1, and a light body 52 holding the discharge lamp DL. Further, the lighting fixture 5 shown in FIG. 6 and the lighting fixture 5 shown in FIG. 7 are provided with their own power feeding lines 53 for electrically connecting the electronic ballasts 1 to the discharge lamps DL. Since the various lighting fixtures 5 as described above can be realized by various well-known techniques to those of skill in the art, any detailed illustrations and descriptions may be omitted as unnecessary.

Thus, although there have been described particular embodiments of the present invention of a new and useful Electronic Ballast with Lamp Flicker Suppression During Start-to-Steady State Transition it is not intended that such references be construed as limitations upon the scope of this invention except as set forth in the following claims.

What is claimed is:

1. An electronic ballast comprising: a power converter arranged to receive DC power input thereto and to convert said DC power input into an AC power output;

a resonant circuit coupled with a discharge lamp and further coupled between output terminals of the power converter; and a controller configured for controlling the power converter with respect to a mode of operation, wherein the controller in a starting operation is configured to set the output frequency of the power converter to a predetermined start frequency upon starting the discharge lamp to make the discharge lamp begin discharging, and the controller is further configured to shift from the starting operation to a steady-state operation by setting the output frequency of the power converter at a predetermined steady-state frequency lower than the start frequency, the steady-state operation providing alternating current power to the lamp for maintaining lighting of the lamp, wherein the predetermined start frequency is set to a frequency identical or close to 1/(n) of the resonant frequency of the resonant circuit with the discharge lamp unlit, and also to a frequency identical or close to the resonant frequency of the resonant circuit with the discharge lamp lit, wherein (n) is an odd whole number greater than or equal to five, and wherein the resonant frequency of the resonant circuit with the discharge lamp unlit is greater than or equal to five times the resonant frequency of the resonant circuit with the discharge lamp lit, and wherein the predetermined start frequency is set to a frequency sufficient to make the discharge lamp start discharging, and to a frequency sufficient to raise a temperature of each electrode of the discharge lamp after startup of the discharge lamp and by an end of the starting operation.

2. The ballast of claim 1, wherein the starting operation has a starting time duration greater than or equal to a sum total of a predetermined minimum time required for making the discharge lamp start discharging and a predetermined minimum time required for heating each electrode after the discharge lamp starts discharging.

3. The ballast of claim 1, wherein the controller is configured to detect the starting of the discharge by the discharge lamp during the starting operation, wherein the controller shifts to the steady-state operation after an elapse of a certain predetermined period of electrode heating time subsequent to the detection of the starting of the discharge by the discharge lamp.

4. The ballast of claim 3, wherein the controller is configured to detect the starting of the discharge by the discharge lamp during the starting operation by detecting a lamp voltage amplitude and comparing said lamp voltage amplitude to a predetermined threshold, wherein starting of the discharge by the discharge lamp is detected where the lamp voltage amplitude is less than the predetermined threshold.

5. The ballast of claim 1, wherein the controller is configured to determine whether a half-wave discharge is generated at the discharge lamp during the starting operation, and wherein the controller shifts to the steady-state operation upon determining that the half-wave discharge is not generated at the discharge lamp.

6. The ballast of claim 5, the controller configured to determine whether a half-wave discharge is generated at the discharge lamp during the starting operation by detecting peak values of both positive and negative polarities of a current across the lamp, comparing a difference between the detected peak values with a predetermined symmetric threshold, and determining that the difference is less than the symmetric threshold.

7. The ballast of claim 1, wherein the controller is configured to shift to the steady-state operation upon elapsing of the latest of:

(a) a starting time duration greater than or equal to a sum total of a predetermined minimum time required for making the discharge lamp start discharging and a predetermined minimum time required for heating each electrode after the discharge lamp starts discharging;

(b) a certain predetermined period of electrode heating time subsequent to a detection by the controller of the starting of discharge by the discharge lamp; and (c) a determination by the controller that a half-wave discharge is not generated at the discharge lamp.

8. An electronic ballast comprising:

a rectifier for rectifying AC power received from an AC power source and providing a DC signal;

a boost converter for converting said rectified DC signal into a DC power output;

a boost converter driving circuit for controlling the DC power output from the boost converter;

a power converter for converting the DC power output from the boost converter into an AC power output;

a resonant circuit coupled with a discharge lamp, and further connected between output terminals of the power converter; and a controller configured for controlling the power converter, wherein the controller is configured to execute an starting operation to make the discharge lamp start discharging by periodically adjusting an output frequency of the power converter within a predetermined start frequency range upon starting of the discharge lamp, and the controller is further configured to shift upon completion of the starting operation to a steady-state operation by setting the output frequency of the power converter at a predetermined steady-state frequency lower than a lower limit of the start frequency range, wherein the predetermined start frequency range includes 1/(an odd whole number greater than or equal to five) of a resonant frequency of the resonant circuit with the discharge lamp unlit, and wherein the resonant frequency of the resonant circuit with the discharge lamp unlit is greater than or equal to five times the resonant frequency of the resonant circuit with the discharge lamp lit, and wherein the predetermined start frequency range further includes a resonant frequency of the resonant circuit with the discharge lamp lit.

9. The ballast of claim 8, wherein the starting operation has a starting time duration greater than or equal to a sum total of a predetermined minimum time required for making the discharge lamp start discharging and a predetermined minimum time required for heating each electrode after the discharge lamp starts discharging.

10. The ballast of claim 8, wherein the controller is configured to detect the starting of the discharge by the discharge lamp during the starting operation, wherein the controller shifts to the steady-state operation after an elapse of a certain predetermined period of electrode heating time subsequent to the detection of the starting of the discharge by the discharge lamp.

11. The ballast of claim 10, wherein the controller is configured to detect the starting of the discharge by the discharge lamp during the starting operation by detecting a lamp voltage amplitude and comparing said lamp voltage amplitude to a predetermined threshold, wherein starting of the discharge by the discharge lamp is detected where the lamp voltage amplitude is less than the predetermined threshold.

12. The ballast of claim 8, wherein the controller is configured to determine whether a half-wave discharge is generated at the discharge lamp during the starting operation, and wherein the controller shifts to the steady-state operation upon determining that the half-wave discharge is not generated at the discharge lamp.

13. The ballast of claim 12, the controller configured to determine whether a half-wave discharge is generated at the discharge lamp during the starting operation by detecting peak values of both positive and negative polarities of a current across the lamp, comparing a difference between the detected peak values with a predetermined symmetric threshold, and determining that the difference is less than the symmetric threshold.

14. The ballast of claim 8, wherein the controller is configured to shift to the steady-state operation upon elapsing of the latest of:

(a) a starting time duration greater than or equal to a sum total of a predetermined minimum time required for making the discharge lamp start discharging and a predetermined minimum time required for heating each electrode after the discharge lamp starts discharging;

(b) a certain predetermined period of electrode heating time subsequent to a detection by the controller of the starting of discharge by the discharge lamp; and (c) a determination by the controller that a half-wave discharge is not generated at the discharge lamp.

15. An electronic ballast comprising: a power converter arranged to receive DC power input thereto and to convert said DC power input into an AC power output; a resonant circuit coupled with a discharge lamp and further coupled between output terminals of the power converter; and a controller configured for controlling the power converter with respect to a mode of operation, wherein the controller is configured to execute an starting operation to make the discharge lamp start discharging by periodically adjusting an output frequency of the power converter within a predetermined start frequency range upon starting of the discharge lamp, and the controller is further configured to shift from the starting operation to a steady-state operation by setting the output frequency of the power converter at a predetermined steady-state frequency lower than a lower limit of the start frequency range, the steady-state operation providing alternating current power to the lamp for maintaining lighting of the lamp, wherein the predetermined start frequency range includes 1/(an odd whole number greater than or equal to five) of a resonant frequency of the resonant circuit with the discharge lamp unlit, and the predetermined start frequency range does not include a resonant frequency of the resonant circuit with the discharge lamp lit, and wherein the resonant frequency of the resonant circuit with the discharge lamp unlit is greater than or equal to five times the resonant frequency of the resonant circuit with the discharge lamp lit, and wherein the start frequency range is set to include a frequency close to the resonant frequency of the resonant circuit with the discharge lamp lit, to an extent capable of sufficiently raising temperature of each electrode of the discharge lamp after the starting of the discharge lamp by end of the starting operation.

16. The ballast of claim 15, wherein the start frequency range includes a frequency greater than and close to the resonant frequency of the resonant circuit with the discharge lamp lit.

17. The ballast of claim 15, wherein the starting operation has a starting time duration greater than or equal to a sum total of a predetermined minimum time required for making the discharge lamp start discharging and a predetermined minimum time required for heating each electrode after the discharge lamp starts discharging.

18. The ballast of claim 15, wherein the controller is configured to detect the starting of the discharge by the discharge lamp during the starting operation, wherein the controller shifts to the steady-state operation after an elapse of a certain predetermined period of electrode heating time subsequent to the detection of the starting of the discharge by the discharge lamp.

19. The ballast of claim 18, wherein the controller is configured to detect the starting of the discharge by the discharge lamp during the starting operation by detecting a lamp voltage amplitude and comparing said lamp voltage amplitude to a predetermined threshold, wherein starting of the discharge by the discharge lamp is detected where the lamp voltage amplitude is less than the predetermined threshold.

20. The ballast of claim 15, wherein the controller is configured to determine whether a half-wave discharge is generated at the discharge lamp during the starting operation, and wherein the controller shifts to the steady-state operation upon determining that the half-wave discharge is not generated at the discharge lamp.

21. The ballast of claim 20, the controller configured to determine whether a half-wave discharge is generated at the discharge lamp during the starting operation by detecting peak values of both positive and negative polarities of a current across the lamp, comparing a difference between the detected peak values with a predetermined symmetric threshold, and determining that the difference is less than the symmetric threshold.

22. The ballast of claim 15, wherein the controller is configured to shift to the steady-state operation upon elapsing of the latest of:

(a) a starting time duration greater than or equal to a sum total of a predetermined minimum time required for making the discharge lamp start discharging and a predetermined minimum time required for heating each electrode after the discharge lamp starts discharging;

(b) a certain predetermined period of electrode heating time subsequent to a detection by the controller of the starting of discharge by the discharge lamp; and (c) a determination by the controller that a half-wave discharge is not generated at the discharge lamp.

* * * * *